US008981678B2

(12) United States Patent
Lee

(10) Patent No.: US 8,981,678 B2
(45) Date of Patent: Mar. 17, 2015

(54) ILLUMINATED MOLDING CONTROL SYSTEMS

(71) Applicant: Scott Lee, Peoria, IL (US)

(72) Inventor: Scott Lee, Peoria, IL (US)

(73) Assignee: Lite It Up, Inc., Washington, IL (US)

( * ) Notice: Subject to any disclaimer, the term of this patent is extended or adjusted under 35 U.S.C. 154(b) by 46 days.

(21) Appl. No.: 13/757,690

(22) Filed: Feb. 1, 2013

(65) Prior Publication Data

US 2014/0217900 A1 Aug. 7, 2014

(51) Int. Cl.
*H05B 37/00* (2006.01)
*H05B 33/08* (2006.01)
*H05B 37/02* (2006.01)

(52) U.S. Cl.
CPC ..... *H05B 33/0863* (2013.01); *H05B 37/029* (2013.01)
USPC ..... 315/312; 315/152; 315/294

(58) Field of Classification Search
USPC ..... 315/149, 152, 291, 294, 297, 312; 362/244
See application file for complete search history.

(56) References Cited

U.S. PATENT DOCUMENTS

| | | | | |
|---|---|---|---|---|
| 8,167,465 | B2 * | 5/2012 | Cha | 362/362 |
| 2004/0156192 | A1 * | 8/2004 | Kerr et al. | 362/154 |
| 2012/0206050 | A1 * | 8/2012 | Spero | 315/152 |
| 2013/0063045 | A1 * | 3/2013 | Ishikita et al. | 315/296 |

* cited by examiner

*Primary Examiner* — Tung X Le
(74) *Attorney, Agent, or Firm* — Sheppard Mullin Richter & Hampton LLP

(57) ABSTRACT

Illuminated moldings with integrated control are provided. The illuminated moldings with integrated control use low voltages, are energy efficient and easy to install and use. The illuminated moldings with integrated control may be attached to various surfaces of different objects. The illuminated molding is insulated and does not carry electricity, and can be placed under water with never a risk of shock even if something damages or cuts the molding. Further, the illuminated moldings with an integrated control allow a user to control various illumination characteristics and effects such as the turn on or turn off time, the color, the brightness, the transition between various operation modes. The integrated control may be wired or wireless.

24 Claims, 6 Drawing Sheets

ILLUMINATED MOLDING CONTROL SYSTEMS

TECHNICAL FIELD

The present invention relates generally to lighting, and more particularly, some embodiments relate to illuminated molding control systems.

DESCRIPTION OF THE RELATED ART

Moldings are materials with various profiles and shapes covering transitions between surfaces or for decoration. Illuminated moldings are moldings that use light to achieve a practical or aesthetic effect, including the use of both artificial light sources as well as natural illumination. However, conventional illuminated moldings carry electricity, which creates significant safety risks especially when the molding may contact water. Typically, control over lighted moldings is inflexible.

BRIEF SUMMARY

Various embodiments of the present invention provide illuminated moldings with integrated lighting control. The illuminated moldings with integrated control provide a low voltage, energy efficient, and easy to install and use lighted moldings In one embodiment, the illuminated molding is non-conductive so it can be in environments exposed to water without a risk of shock even if the molding is damaged. Further, the features and functionality of the illuminated moldings with an integrated control allow a user to control various illumination characteristics and effects such as the turn on or turn off time, the color, the brightness, the transition between various operation modes. The integrated control may be wireless or wired. For example, the system may be controlled by wireless remote controls with varying feature levels, wired remote control devices, or control buttons on the system housing. Still further embodiments may be controlled by external input. For example, some embodiments may flash to the rhythm of the music or respond to ambient light levels.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

According to various embodiments, an illuminated molding is provided. The illuminated molding comprises: 1) a light conduit configured to carry light, and 2) a mounting member attached to a surface of the light conduit, the mounting member configured to mount the illuminated molding to an object.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION

The present invention is directed toward an illuminated molding with integrated control that may be utilized both indoors and outdoors. Various embodiments of the present invention provide illuminated moldings with integrated control systems. The features and functionality of illuminated moldings with integrated control systems provide low voltage, energy efficient, and easy to install and use moldings. Various embodiments may comprise a centralized light or power source with the light distributed via the illuminated molding without additional lighting components. In some embodiments, attachment surfaces allow the illuminated moldings to be attached to various surfaces of different objects. In one embodiment, the illuminated molding is non-conductive and does not carry electricity, and can be placed under water without a risk of shock even if something damages or cuts the molding. Further, the features and functionality of the illuminated moldings and integrated control systems allow a user to control various illumination characteristics and effects such as the turn on or turn off time, the color, the brightness, and the transition between various operation modes. In addition, some embodiments may flash to the rhythm of music.

The features and functionality of the lighting control system make various embodiments to be plug and play ready. In some embodiments, the illuminated molding with integrated control may provide a one button control that allow a user to set on and off time, to set the on and off period, to set the sensitivity to light, to set the sensitivity to sound, to select the operation mode, to choose a dimming option, and to select an illumination color.

Various embodiments are energy efficient compared with a distributed light source such as a rope light or a ribbon light because there are fewer electrical connections and fewer lights per foot.

Figure 1:
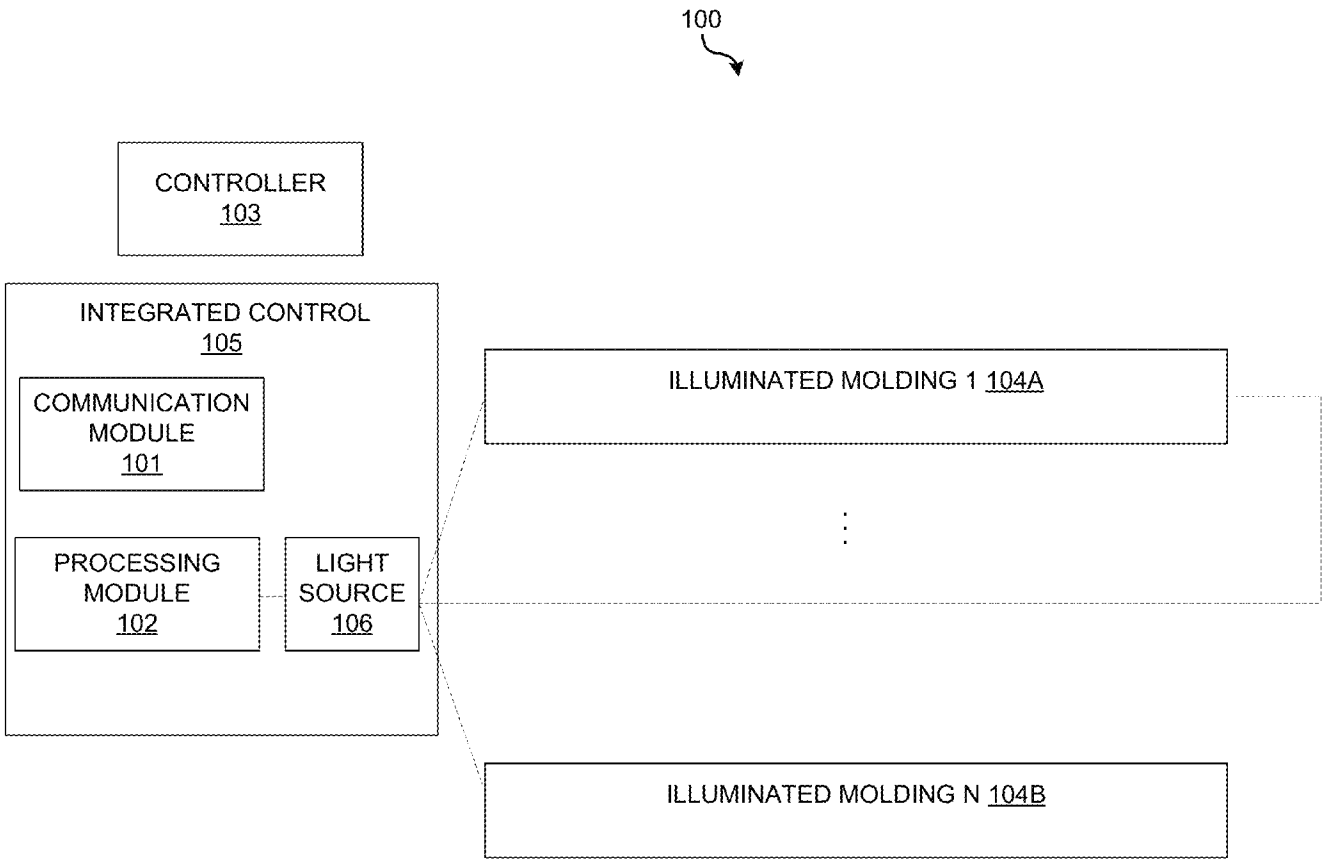
FIG. 1 is a diagram illustrating an example illuminated molding control system in accordance with an embodiment.

FIG. 1 is a diagram illustrating an example illuminated molding control system 100 in accordance with an embodiment. The illuminated molding control system 100 comprises an integrated control system 105 comprising a communication module 101, a processing module 102, and a controller 103. The communication module 101 is configured to receive a control signal. The control signal may carry instructions on how to regulate a set of illuminated moldings 104A-B, for example. The processing module 102 may be coupled to the communication module 101, process the control signal, and adjust light to the set of illuminated moldings 104A-B. In one embodiment, the control signal may be an infrared control signal, such as a stream of pulses of infrared light. The processing module 102 demodulates the control signal and adjusts light to the set of illuminated moldings 104A-B accordingly. In various embodiments, the controller 103 may generate and transmit the control signal according to a user's instruction. The controller 103 may comprise a set of keys. In one embodiment, when a user presses a key of the controller 103, the controller 103 may generate a stream of infrared pulses having a unique pattern to the key and transmit the stream of infrared pulses. The processing module may recognize the unique pattern and adjust the light to the set of illuminated moldings 104A-B according to the instructions corresponding to the key. In other embodiments, the controller 103 may communicate with the communication module 101 in various communications protocols such as Bluetooth, Zigbee, 802.11 protocols, IR, RF, or any other wireless protocol.

In further embodiments, the integrated control system 105 may comprises a light source 106. The light source may be a light emitting diode (LED), an organic light emitting diode (OLED), a xenon bulb, a halogen bulb, and an electroluminescent (EL) light source (e.g., an EL panel or film), or any combination thereof. The light source 106 generates the light that is supplied to the set of illuminated moldings 104A-B.

In various embodiments, different components or modules of the illuminated molding control system 100 are mounted on a printed circuit board (PCB). In one embodiment, the communication module 101 and the processing module 102 are mounted on the same PCB and packaged as the integrated control system 105, whereas the controller 103 is mounted on a different PCBs and packaged together or separately. In another embodiment, the communication module 101, the processing module 102 and the light source 106 are mounted on the same PCB and packaged as the integrated control system 105.

In further embodiments, the illuminated molding control system 100 may comprise a set of illuminated moldings 104A-B. In some embodiments, the set of illuminated moldings 104A-B may be coupled to the integrated control system 105. In one embodiment, both ends of the illuminated molding 104A are coupled to the integrated control system 105. In one embodiment, the integrated control system 105 and the set of illuminated moldings 104A-B are configured to minimize light loss between the light source 106 and the illuminated molding 104A. For example, the light source 106 may interface with the illuminated molding 104A using a fiber optic coupler.

In various embodiments, the set of illuminated moldings 104A-B may be coupled to the integrated control system 105 via a set of cables. The set of cables may comprise a female connector and/or a male connector such that power and control signals may be delivered to an illuminated molding. In some embodiments, the integrated control system 105 may comprise a USB port or a micro USB port. In one embodiment, the integrated control system 105 may be coupled to a power source via the USB port or the micro USB port. In these embodiments, the light sources 106 may be housed in the cable connector coupled to the illuminated moldings 104A-B.

In further embodiments, the integrated control system 105 may comprise an audio jack. In another embodiment, the integrated control system 105 may be coupled to an audio source via the audio jack. In one embodiment, the integrated control system 105 may comprise a sound sensor. The integrated control system 105 may regulate light supplied to the illuminated moldings 104A-B according to the sound from the audio source. For example, the integrated control system 105 may regulate the light according to the rhythm of the sound depending on the sensitivity to the sound. A user may select the sensitivity and the integrated control system 105 may adjust the light based on the selected sensitivity (for example, low, medium or loud sound.) In various embodiments, the integrated control system 105 may comprise a light sensor such that the integrated control system 105 is sensitive to light. Accordingly, when the integrated control system 105 senses light, no light will be supplied to the set of illuminated moldings 104A-B.

Figure 2:
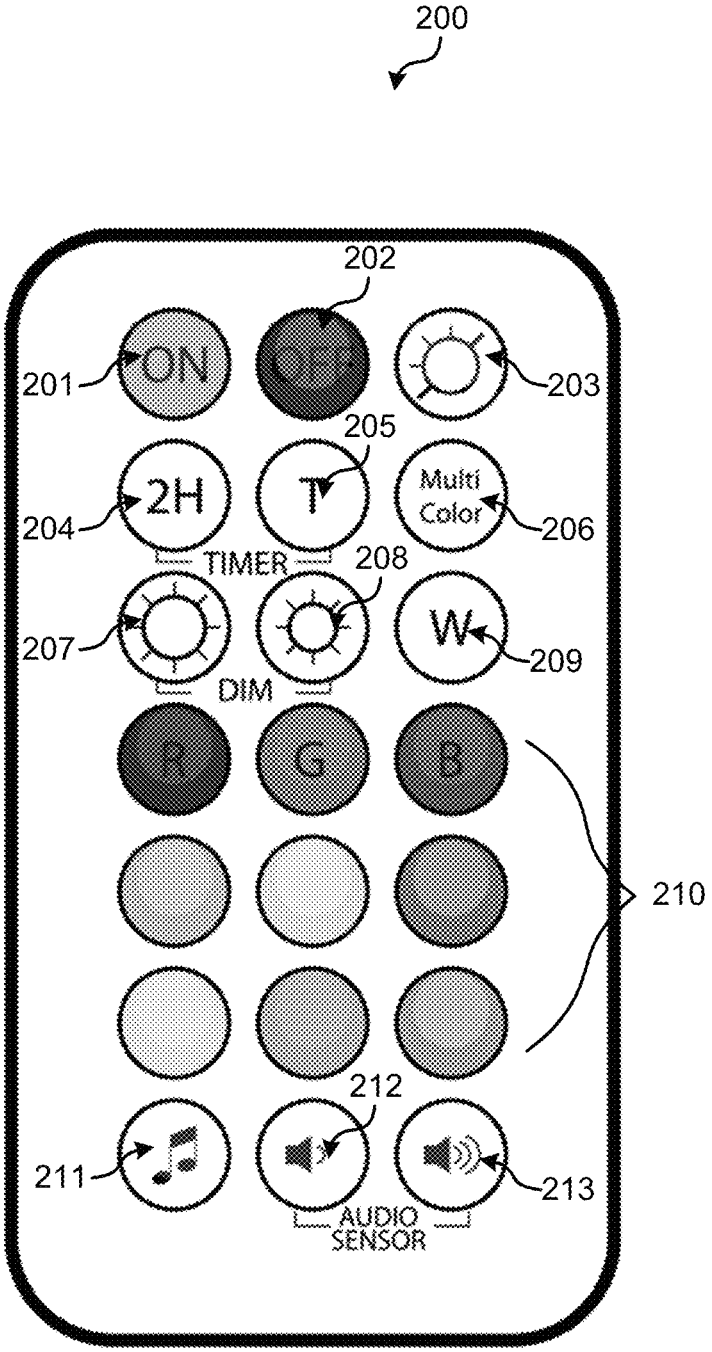
FIG. 2 illustrates an example illuminated molding controller in accordance with an embodiment.

FIG. 2 illustrates an example illuminated molding controller 200 in accordance with an embodiment. The illustrated example controller 200 comprises a set of keys for controlling an illuminated molding. Example keys include ON and OFF keys 201, 202, which allow a user to turn on or turn off the light source. In some embodiments, an illuminated molding may be sensitive to light. Key 203 may be used to control the sensed light threshold value. If the light sensed is above the threshold value, then no light is supplied to the illuminated molding. In one embodiment, the threshold value is below the threshold value, then light is supplied to the illuminated molding. In other embodiments, key 203 may be used to activate or deactivate the light sensing feature.

In some embodiments, an illuminated molding may operate in a timer mode. For example, the illuminated molding may operate for a time period specified by the user. The system may have a preset timer value, such as two hours, and when a user presses the key 204, light may be supplied to an illuminated molding for two hours or the preset value. The system may also have an adjustable value set by pressing the key 205, in which light may be supplied to the illuminated molding for certain time on a periodic basis. For example, light may be supplied to an illuminated molding for five hours on a 24 hour basis.

An illuminated molding may further operate in a multicolor mode. Key 206 may be used to toggle between the multicolor mode and a default mode (such as a white light mode). When operating in the multicolor mode, various colors of light may be supplied to the illuminated molding. In some embodiments, an illuminated molding may operate in multiple sub-modes under a multicolor mode. The illuminated molding may operate in a fade mode: the illuminated molding performs a slow fade transition from one color to another. The illuminate molding may operate in a flash mode: the illuminated molding performs a quick flash transition from one color to the next.

Keys 207 and 208 may adjust the brightness of an illuminated molding: the key 207 may increase the brightness and the key 208 may decrease the brightness. In one embodiment, four brightness settings may be selected such as 25%, 50%, 75%, and 100%. Keys 209-210 may allow a user to select the color of light in which an illuminated molding operates. The key 209 selects the color white and the keys 210 may select a color corresponding to the color displayed on the key. In various embodiments, a color may be provided by blending red light, green light, and blue light in various percentages. In further embodiments, a user may control the percentages of red, green, and blue light to create a user-defined color. In one embodiment, the illuminated molding operates in a solid color mode when a color is selected by pressing the corresponding key. The solid color mode interrupts and overrides the multicolor mode. In some embodiments, an illuminated molding may be coupled with an audio source, by pressing the key 211, a user may activate the music mode. When operating in the music mode, light is regulated according to the rhythm of the sound such that the illuminated molding may flash to the sound. A user may adjust the sound sensitivity via keys 212 and 213, and the illuminated molding may flash to different volume of the sounds, for example, low, medium and loud sound. The key 212 decreases the sensitivity level and the key 213 increases the sensitivity level, this could also be done using a dial control.

Figure 3:
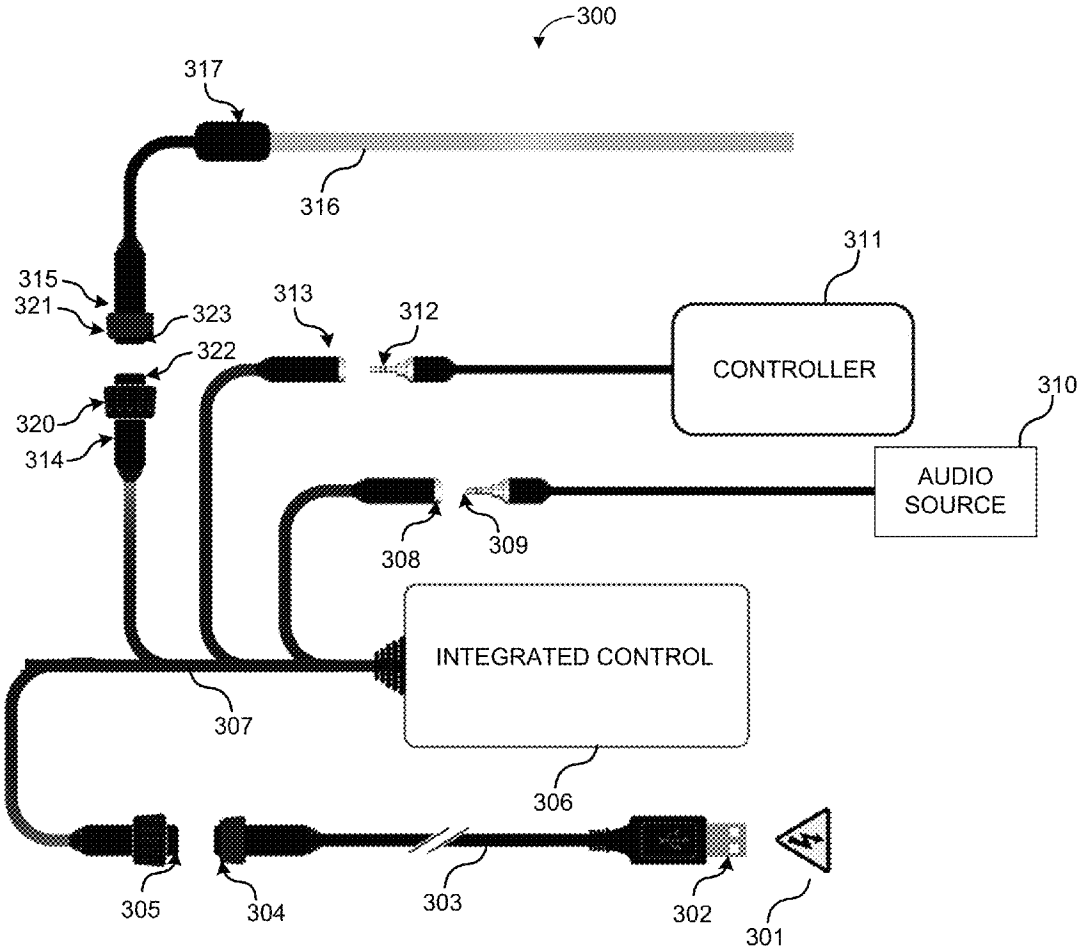
FIG. 3 is a diagram illustrating an illuminated molding system in accordance with an embodiment.

FIG. 3 is a diagram illustrating an illuminated molding system 300 in accordance with an embodiment of the invention. The illuminated molding system 300 comprises an illuminated molding 316, an integrated control system 306, a controller 311, an audio source 310, a power source 301, and cables 303 and 307. The illuminated molding may be configured with one or more identically colored light sources that allow for variable light intensity, or one or more different-colored light sources that allow for different color patterns. In some embodiments, if multiple light sources are operated synchronously so that all light sources are active or inactive at the same times.

The integrated control 306 and the controller 311 may be used in some embodiments to control the behavior and parameters of the illuminated molding 316. For example, the integrated control 306 or the controller 311 may control the color pattern, light intensity, or timing of light patterns of the illuminated molding 316. Some embodiments are implemented with tool-less connectors that allow for easy removal and replacement. For example, in the illuminated molding system 300, the system is configured with a jack 304 and receptacle 305, allowing the power source 301 to be easily disconnected from the illuminated molding system 300 without the need for tools. Further, the illuminated molding system 300 may be configured with a plug 315 and receptacle 314, which allows the illuminated molding 316 to be easily connected or disconnected. The plug 315 and the receptacle 314 may be configured to form a secure and waterproof connection. For example, the receptacle 314 may comprise a sliding threaded member 320 and the plug 315 may comprise a fixed threaded member 321. The end portion 322 of the receptacle 314 fits snugly with the end portion 323 of the plug 322, and the sliding threaded member 320 covers and locks with the fixed threaded member 321. In various embodiments, the illuminated molding system 300 may be configured with audio jack 309 and audio receptacle 308 . It may also be configured with wire connections 313 and 312 for wired controller. These connections will allow the audio source 310 and the controller 311 to be easily connected or disconnected. The illustrated controller 311 is a wired controller and may controls similar to the illuminated molding controller 200. In further embodiments, the illuminate molding system 300 may comprise a light sensor, which may be coupled to the integrated control 306 via an audio jack and an audio receptacle.

In various embodiments, an illuminated molding 316 may comprise a light generator 317. The light generator 317 is configured to generate light. The light generator 317 is integrated with the illuminated molding 316. In various embodiments, the light generator 317 comprises a chamber that houses a light source and provides a coupling location for a portion of the molding 316. The light generator 317 may receive control signals from the integrated control 306 or the controller 311 and the light source may be adjusted accordingly. In some embodiments, the light generator 317 may be integrated with a plurality of illuminated moldings 316. For example, in one embodiment, the light generator 317 is T-shaped and integrated with two illuminated moldings 316. In another embodiment, the light generator is star-shaped and integrated with five illuminated moldings 316. In certain embodiments of the invention, the illuminated molding system may be further configured with male or female connectors that allow multiple illuminated moldings to be implemented together, either in parallel or in series. For example, the cable 307 may comprise two or more female receptacles 314, and each female receptacle may be configured with a male plug 315 such that two or more illuminated moldings 316 may be implemented in series or in parallel. In still further embodiments, multiple light generators 317 may be coupled to the molding 316 at various space-apart location. For example, the light generator 317 may comprise an LED light ribbon and molding 316 may be optically coupled to the face of the light ribbon.

Figure 4A:
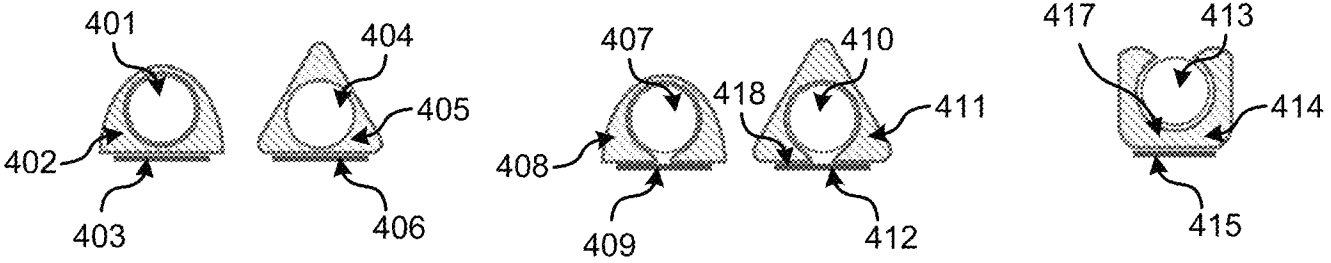
FIGS. 4A-4D illustrate cross-sectional side views of illuminated moldings in accordance with various embodiments.
Figure 4B:
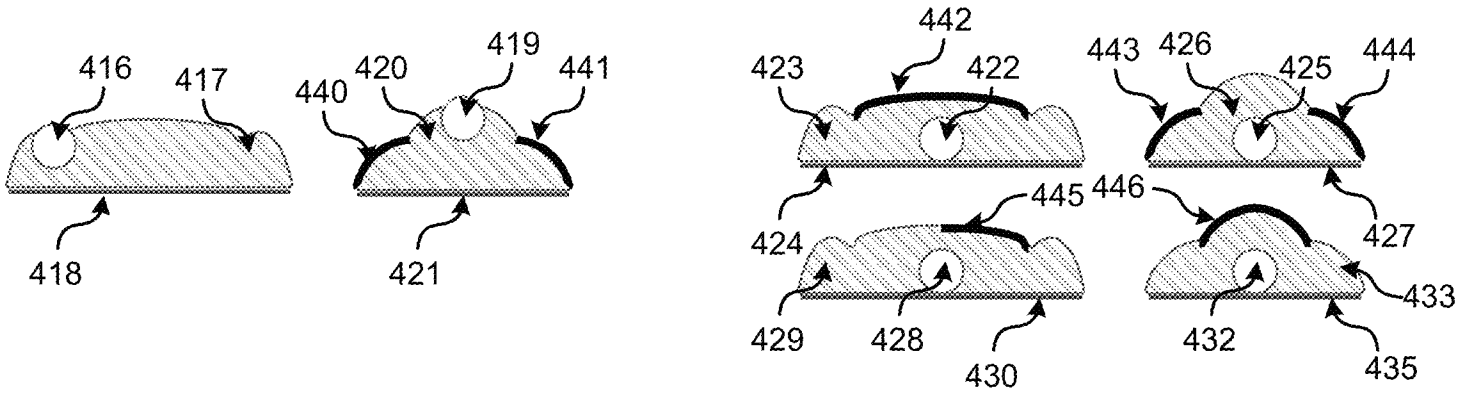

FIGS. 4A-4D illustrate cross-sectional side views of illuminated moldings in accordance with various embodiments of the invention. In some embodiments, as illustrated in FIGS. 4A, an illuminated molding comprises a light conduit 401, 404, 407, 410, or 413, a sheath 402, 405, 408, 411, or 414, and a mounting member 403, 406, 409, 412, or 415. The light conduit 401, 404, 407, 410, or 413 may be a Polymethyl methacrylate (PMMA) core, plastic core or a fiber optic core and may be configured to carry and emit light along its length. The sheath 402, 405, 408, 411, or 414 may comprise a fiber optic cladding material, such as a fluorinated polymer. Alternatively, the sheath may comprise other plastics. The illuminated molding carries no electricity and may be implemented safely in various environments including under the water.

The sheath 402, 405,408, 411, or 414 at least partially encloses the light conduit 401, 404, 407, 410, or 413, respectively. Additionally, at least one surface of the illuminated molding emits light. In some embodiments, the sheath 402, 405,408, 411, or 414 may be transparent and may not cause total internal reflection in the core, so that light is emitted through the sheath. In other embodiments, the sheath 414 does not completely surround the core 413. Light is emitted from the surface of the core 413 that is uncovered. The sheath 402, 405,408, 411, or 414 may be colored to filter the emitted light. In some embodiments, a surface 417 of the sheath may be reflective. The reflective surface may face the core, so that light emitted from the core onto the surface is reflected back through the core. In other embodiments, a surface 418 of the mounting member may be configured to reflect light. In still further embodiment, all or a portion of the sheath material is opaque. Accordingly, an illuminated molding may be configured to preferentially emit light in certain directions.

Furthermore, the mounting member 403, 406, 409, 412, or 415 may be attached to a surface of the sheath 402, 405,408, 411, or 414, respectively. The mounting members 403, 406, 409, 412, and 415 are configured such that the illuminated molding may be mounted to a surface of an object. In various embodiments, the mounting members 403, 406, 409, 412, and 415 are double faced tapes. In other embodiments, a surface of the sheath may be treated with a coating. For example, the surfaces 440 and 441 of the sheath 420, the surface 442 of the sheath 423, the surfaces 443 and 444 of the sheath 426, the surface 445 of the sheath 429, and the surface 446 of the sheath 433 are treated with a coating. The coating may be chrome or other materials in various colors, texture or patterns.

Figure 4C:
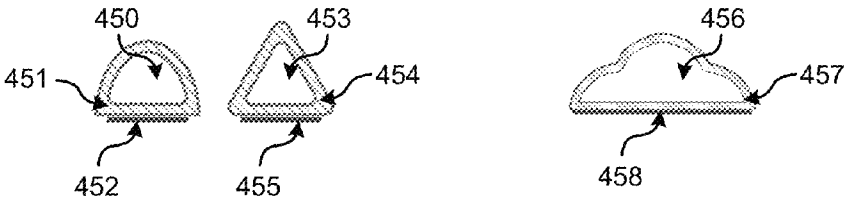

One of ordinary skill in the art would appreciate that the light conduit and the sheath may be in different shapes and made of various materials that carry and emit light. For example, as illustrated in FIG. 4C, illuminated light moldings comprise the light conduits 450, 453, and 456 that are in different shapes.

Figure 4D:
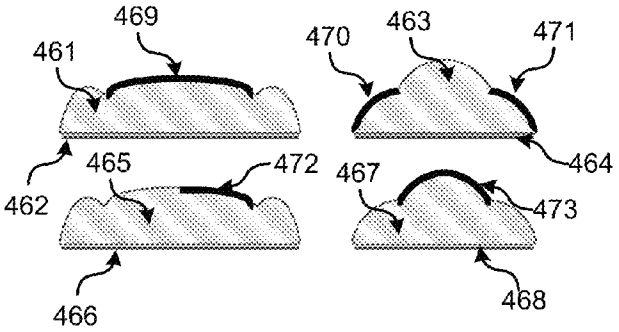

In further embodiments, as illustrated in FIG. 4D, an illuminated molding may comprise a light conduit 461, 463, 465, or 467 in various shapes, and a mounting member 462, 464, 466, or 468. The light conduit 401, 404, 407, 410, or 413 may be a PMMA core or a fiber optic core and may be configured to carry light, and accordingly, emits light. Both the light conduit and the sheath are non-conductive. Accordingly, an illuminated molding carries no electricity and may be implemented safely in various environments including under the water. The light conduit 461, 463, 465, or 467 may carry light but are insulated and carry no electricity. The surface 469 of the light conduit 461, the surfaces 470 and 471 of the light conduit 463, the surface 472 of the light conduit 465, and the surface 473 of the light conduit 467 may be treated with a coating. In various embodiments, the coating could be chrome or other materials in various colors, texture or patterns.

Furthermore, the mounting members 462, 464, 466, and 468 are configured such that the illuminated molding may be mounted to a surface of an object. In various embodiments, the mounting members 462, 464, 466, or 468 may be double faced tapes or mounting fixtures (such as suction cups, adhesive clips, etc.)

Figure 5:
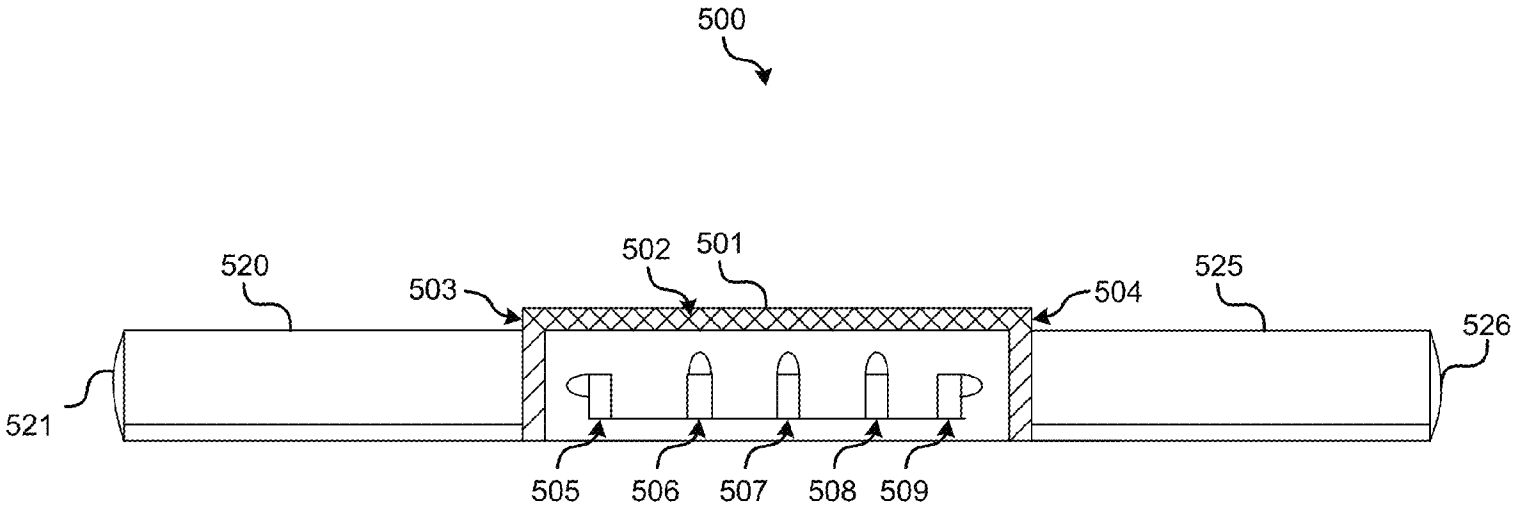
FIG. 5 illustrates an example illuminated molding in accordance with an embodiment.

FIG. 5 illustrates an example illuminated molding 500 in accordance with an embodiment. The illuminated molding 500 may comprise a light generator 501. The light generator 501 may be configured to be coupled to a power source (not shown). The light generator 501 may comprise a chamber 502 that houses a light source and is sealed. The chamber 502 may be sealed and configured to be waterproof. In some embodiments, the top surface 502 is opaque. In other embodiments, the top surface 502 is clear. The side surfaces 503 and 504 may be transparent to allow light pass through. Accordingly, the light generator 501 emits light. In some embodiments, the chamber 502 is a lens such as a Fresnel lens. In the illustrated example, the light chamber 501 houses multiple light sources 505-509, where the light sources 505 and 509 are configured to face the transparent surfaces 503 and 504, and the light sources 506-508 may be configured to face various directions. In various embodiments, the light sources 505-509 may be LEDs or other suitable light source and may be mounted onto one PCB. In the illustrated example, the light generator 501 is integrated with the light conduits 520 and 525 such that minimal or no light loss occurs. The light conduits 520 and 525 are positioned adjacent to the transparent surfaces 503 and 504. As such, light emitted from the light generator 501 may shine onto the light conduits 520 and 525. In the illustrated example, the illuminated molding 500 may comprise reflective caps 521 and 526 configured to cover an end of the light conduit 520 and 525. The reflective caps 521 and 526 reflect light and increase the light intensity carried by the light conduit 520 and 525, respectively. In various embodiments, the reflective caps 521 and 526 are coated with chrome or materials in various colors, texture or patterns. While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. An illuminated molding control system configured to be coupled to a set of illuminated moldings, comprising:

a communication module configured to receive a control signal;

a processing module coupled to the receiver module, the processing module adjusting light to the set of illuminated moldings according to the control signal; and the set of illuminated moldings, wherein an illuminated molding of the set of illuminated moldings comprises a light conduit configured to carry light, and a mounting member attached to a surface of the light conduit, the mounting member configured to mount the illuminated molding to an object.

2. The illuminated molding control system of claim 1, further comprising a controller configured to generate and transmit the control signal.

3. The illuminated molding control system of claim 2, wherein the control signal is an infrared light signal, a bluetooth signal, or a radio frequency signal.

4. The illuminated molding control system of claim 1, wherein a second surface of the light conduit is treated with a coating.

5. The illuminated molding control system of claim 4, wherein the coating is chrome.

6. The illuminated molding control system of claim 1, wherein the light conduit is a PMMA core.

7. The illuminated molding control system of claim 1, wherein the light conduit is a fiber optic core.

8. The illuminated molding control system of claim 1, wherein the illuminated molding further comprises a sheath at least partially surrounding the light conduit.

9. The illuminated molding control system of claim 8, wherein the sheath is transparent.

10. The illuminated molding control system of claim 8, wherein the sheath is colored.

11. The illuminated molding control system of claim 8, wherein a surface of the sheath is configured to reflect light.

12. The illuminated molding of claim 11, wherein the surface of the sheath faces the light conduit.

13. The illuminated molding control system of claim 1, wherein a surface of the mounting member is configured to reflect light.

14. The illuminated molding control system of claim 1, wherein the illuminated molding further comprises a light generator configured to generate light.

15. The illuminated molding control system of claim 14, wherein the light generator is integrated with the light conduit.

16. The illuminated molding control system of claim 14, wherein the light generator comprises a plurality of LEDs optically coupled to the molding.

17. The illuminated molding control system of claim 14, further comprising a light source coupled to the light generator, wherein the light generator comprises a chamber, the chamber houses the light source and is sealed.

18. The illuminated molding control system of claim 17, further comprising a cable coupled to the processing module and the light source.

19. The illuminated molding control system of claim 1, further comprising an internal clock.

20. The illuminated molding control system of claim 1, wherein the control signal adjusts a time, a color, or a dimming option of the light.

21. The illuminated molding control system of claim 1, further comprising an audio jack configured to be coupled to an audio source.

22. The illuminated molding control system of claim 21, wherein the processing module controls the light according to the rhythm of the audio source.

23. The illuminated molding control system of claim 1, further comprising a light sensor, wherein if the light sensed by the light sensor is above a predetermined value, no light is supplied to the set of illuminated moldings.

24. The illuminated molding control system of claim 1, further comprising a reflective cap configured to cover an end of the light conduit.

* * * * *